US009424987B2

(12) United States Patent
Duval

(10) Patent No.: US 9,424,987 B2
(45) Date of Patent: Aug. 23, 2016

(54) THREE-PHASE/TWO-PHASE ROTARY TRANSFORMER INCLUDING A SCOTT CONNECTION

(71) Applicant: LABINAL POWER SYSTEMS, Blagnac (FR)

(72) Inventor: Cedric Duval, Samois sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 0 days.

(21) Appl. No.: 14/420,800

(22) PCT Filed: Aug. 14, 2013

(86) PCT No.: PCT/FR2013/051943

§ 371 (c)(1),
(2) Date: Feb. 10, 2015

(87) PCT Pub. No.: WO2014/029941

PCT Pub. Date: Feb. 27, 2014

(65) Prior Publication Data

US 2015/0206652 A1 Jul. 23, 2015

(30) Foreign Application Priority Data

Aug. 23, 2012 (FR) ..... 12 57948

(51) Int. Cl.
*H01F 21/06* (2006.01)
*H01F 27/02* (2006.01)
(Continued)

(52) U.S. Cl.
CPC ..... *H01F 38/18* (2013.01); *H01F 27/28* (2013.01); *H01F 30/14* (2013.01)

(58) Field of Classification Search
CPC ..... H01F 21/06; H01F 21/00
USPC ..... 336/65, 83, 115, 119, 130, 173, 336/180–184, 220–223, 212
See application file for complete search history.

(56) References Cited

U.S. PATENT DOCUMENTS 5,572,178 A * 11/1996 Becker ..... H01F 38/18 336/120
6,388,548 B1 * 5/2002 Saito ..... H01F 38/18 336/117
6,512,437 B2 * 1/2003 Jin ..... H01F 38/14 336/120
6,559,560 B1 * 5/2003 Jin ..... H01F 38/14 307/104
2011/0050377 A1 3/2011 Bjerknes et al.
(Continued)

FOREIGN PATENT DOCUMENTS

FR 2596195 A1 9/1987
WO 2009/128724 A1 10/2009
WO 2012/055443 A1 5/2012

OTHER PUBLICATIONS

International Search Report issued Dec. 19, 2013 in PCT/FR2013/051943 filed Aug. 14, 2013.

*Primary Examiner* — Tsz Chan
(74) *Attorney, Agent, or Firm* — Oblon, McClelland, Maier & Neustadt, L.L.P.

(57) ABSTRACT

A three-phase/two-phase rotary transformer, includes a first single-phase rotary transformer and a second single-phase rotary transformer, the first transformer including a first body defining a first slot, a first coil in the first slot, a second body defining a second slot, and a second coil in the second slot, the second transformer including a third body defining a third slot, a third coil in the third slot, a fourth body defining a fourth slot, and a fourth coil in the fourth slot, wherein one terminal of the first coil is connected to the midpoint of the third coil, the first body, the first coil, the third body, and the third coil forming a three-phase portion of the transformer, the second body, the second coil, the fourth body, and said fourth coil forming a two-phase portion of the transformer.

7 Claims, 5 Drawing Sheets

(51) Int. Cl.

| | |
|---|---|
| ***H01F 21/04*** | (2006.01) |
| ***H01F 27/28*** | (2006.01) |
| ***H01F 27/24*** | (2006.01) |
| ***H01F 38/18*** | (2006.01) |
| ***H01F 30/14*** | (2006.01) |

(56) References Cited

U.S. PATENT DOCUMENTS

| | | | | |
|---|---|---|---|---|
| 2013/0224013 | A1 | 8/2013 | De Broe | |
| 2014/0340185 | A1* | 11/2014 | Verleur ..... | H01F 27/245 336/120 |

* cited by examiner 11
12
13
14
15
16
17
21
22
23
24
25
26
26a
26b
27
110
A 11
12
13
14
15
16
17
21
22
23
24
25
26
26a
26b
27
50
51
51a
51b
310
A

THREE-PHASE/TWO-PHASE ROTARY TRANSFORMER INCLUDING A SCOTT CONNECTION

BACKGROUND OF THE INVENTION

The present invention relates to the general field of transformers. In particular, the invention relates to a three-phase/two-phase transformer.

In certain situations, it may be necessary to transfer energy or signals in balanced manner from a three-phase source to a two-phase source. There exist three-phase/two-phase transformers that are stationary, and in particular one known as a "Scott connection" and another known as a "Leblanc connection".

FIG. 1 is a diagram of the Scott connection. Two single-phase transformers 1 and 2 are used. The transformer 1 has a primary 3 with $n_1$ turns and a secondary 6 with $n_2$ turns. The transformer 2 has a primary 4 with $n'_1$ turns and a secondary 7 with $n_2$ turns.

In FIG. 1, there can be seen:

A, B, and C, which are the points for connection to the three-phase network;

$I_a$, $I_b$, and $I_c$, which are the three-phase currents entering via the points A, B, and C; and $V_1$, $I_1$, $V_2$, $I_2$, which are the two-phase voltages and currents.

The transformer 1 has its $n_1$-turn primary 3 connected between the terminals A and B of the three-phase network. The transformer 2 has its $n'_1$-turn primary 4 connected between the terminal C of the three-phase network and the midpoint 5 of the primary 3 of the transformer 1.

The primary voltages are in quadrature, as are the secondary voltages $V_1$ and $V_2$.

For a ratio $n'_1=(\sqrt{3}/2)n_1$, the secondary voltages $V_1$ and $V_2$ have the same value and they are in quadrature. The ratio of the currents is given by:

$$\frac{I_c}{I_2} = \frac{2}{\sqrt{3}}\frac{n_2}{n_1}$$

When it is desired to transfer energy or signals in balanced manner from a three-phase source to a two-phase source in reference frames that are rotating relative to each other, one solution consists in using a stationary three-phase/two-phase transformer and two single-phase rotary transformers. Another solution consists in using three single-phase rotary transformers in a Leblanc connection.

Nevertheless, both of those solutions require considerable weight and volume. Furthermore, the first solution encounters current inrush problems when switching on and also problems of residual magnetization.

There thus exists a need for an improved solution that enables energy to be transferred in balanced manner from a three-phase source to a two-phase source in reference frames that are rotating relative to each other.

OBJECT AND SUMMARY OF THE INVENTION

The invention provides a three-phase/two-phase rotary transformer, characterized in that it comprises a first single-phase rotary transformer and a second single-phase rotary transformer, the first transformer comprising a first body made of ferromagnetic material defining a first annular slot of axis A, an $n'_1$-turn first toroidal coil of axis A in the first slot, a second body made of ferromagnetic material defining a second annular slot of axis A that is open towards the first slot, and an $n_2$-turn second toroidal coil of axis A in the second slot;

the second transformer comprising a third body made of ferromagnetic material defining a third annular slot of axis A, an $n_1$-turn third toroidal coil of axis A in the third slot, a fourth body made of ferromagnetic material defining a fourth annular slot of axis A that is open towards the third slot, and an $n_2$-turn fourth toroidal coil of axis A in the fourth slot, wherein one terminal of the first coil is connected to the midpoint of the third coil, the first body, said first coil, the third body, and the third coil being stationary relative to one another and forming a three-phase portion of the transformer, the second body, said second coil, said fourth body, and the fourth coil being stationary relative to one another and forming a two-phase portion of the transformer, and the three-phase portion and the two-phase portion being movable in rotation about the axis A relative to each other.

Since the same transformer made up of two single-phase rotary transformers serves firstly to perform three-phase/two-phase transformation and secondly to provide transmission between two reference frames that are rotating relative to each other, these two functions are performed with limited volume and weight. Furthermore, it has been found that this connection makes it possible to obtain transfer that is balanced.

In an embodiment, $n'_1=(\sqrt{3}/2)n_1$.

The ratio between the section of the electrically conductive material of the first coil and the section of the electrically conductive material of the third coil may be equal to $\sqrt{3}$. It is thus possible to compensate for the different numbers of turns between the two coils. This enables resistances to be balanced. In the event of the coils being at different distances from the axis of rotation, this ratio should be reevaluated accordingly.

In an embodiment, the second coil comprises a first half-coil and a second half-coil that are joined together by the midpoint, the winding directions of the half-coils corresponding to magnetic potentials of opposite directions for currents entering via the terminals of the second coil.

The two-phase portion further includes at least one set of three-phase coils. This makes it possible to provide a transformer having a plurality of secondaries that can power an arbitrary number of loads greater than one in balanced manner.

The three-phase portion may surround the two-phase portion relative to the axis A, or vice versa. This corresponds to a "U-shaped" embodiment.

The three-phase portion and the two-phase portion may be situated one beside the other in the direction of the axis A. This corresponds to a "E-shaped" or "pot-shaped" embodiment.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF EMBODIMENTS

Figure 2:
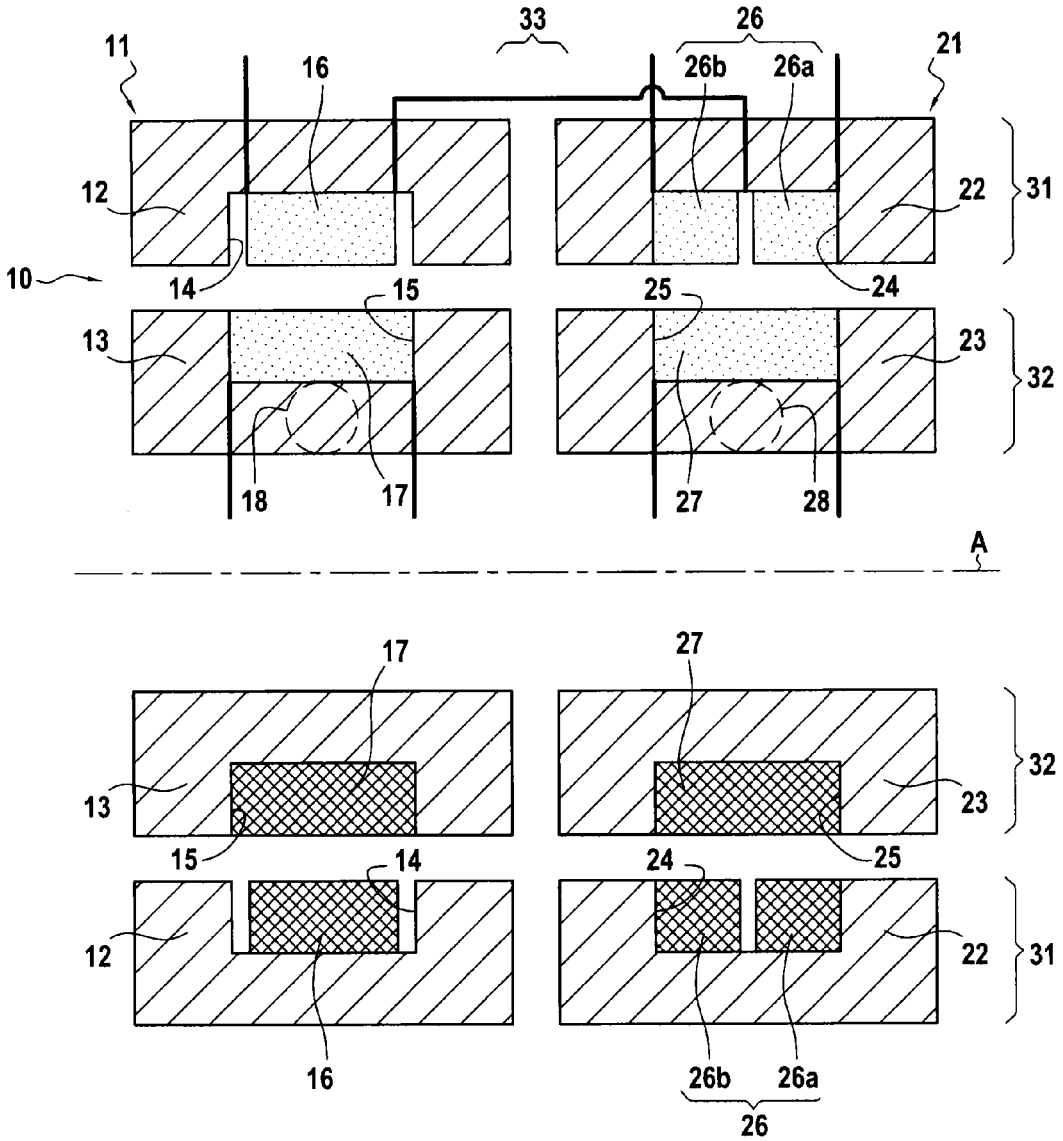
FIG. 2 is a section view of a three-phase/two-phase rotary transformer in a first embodiment of the invention.

FIG. 2 is a section view of a transformer 10 in a first embodiment of the invention. The transformer 10 is a three-phase/two-phase rotary transformer.

The transformer 10 comprises two single-phase rotary terminals, namely a transformer 11 and a transformer 21.

The transformer 11 comprises:

- a body 12 made of ferromagnetic material in the form of a ring of axis A and having a slot 14 formed therein that is open towards the axis A;
- an $n'_1$-turn toroidal coil 16 of axis A in the slot 14;
- a body 13 made of ferromagnetic material, in the form of a ring of axis A surrounded by the body 12 about the axis A and having formed therein a slot 15 that is open towards the slot 14; and
- an $n_2$-turn toroidal coil 17 of axis A in the slot 15.

The bodies 12 and 13 are movable in rotation relative to each other about the axis A.

In corresponding manner, the transformer 21 comprises:

- a body 22 made of ferromagnetic material, in the form of a ring of axis A and having formed therein a slot 24 that is open towards the axis A;
- an $n'_1$-turn toroidal coil 26 of axis A in the slot 24;
- a body 23 made of ferromagnetic material, in the form of a ring of axis A, surrounded by the body 22 about the axis A and having formed therein a slot 25 that is open towards the slot 24; and
- an $n_2$-turn toroidal coil 27 of axis A in the slot 25.

The term "toroidal" is not used restrictively in the sense of a solid generated by rotating a circle about an axis. On the contrary, as in the example shown, the section of a toroidal coil may, in particular, be rectangular.

The coil 26 is made up of two half-coils 26*a* and 26*b* each having $n_1/2$ turns. The bodies 22 and 23 are movable in rotation relative to each other about the axis A.

In the transformer 10, the bodies 12 and 22 and the coils 16 and 26 are stationary relative to one another. The coils 16 and 26 may be connected to a three-phase source. The bodies 12 and 22 and the coils 16 and 26 thus form parts of a three-phase portion 31 of the transformer 10. Likewise, the bodies 13 and 23 and the coils 17 and 27 are stationary relative to one another. The coils 17 and 27 may be connected to a two-phase source. The bodies 13 and 23 and the coils 17 and 27 thus form parts of a two-phase portion 32 of the transformer 10.

The three-phase portion 31 and the two-phase portion 32 are movable in rotation about the axis A relative to each other. For example, the three-phase portion 31 may be a stator and the two-phase portion 32 a rotor, or vice versa. In a variant, both the three-phase portion 31 and the two-phase portion 32 are movable in rotation relative to a stationary reference frame (not shown).

Furthermore, the magnetic circuit of the transformer 11 as formed by the bodies 12 and 13 is separated from the magnetic circuit of the transformer 21 as formed by the bodies 22 and 23 by a space 33. In other words, said transformers 11 and 12 are magnetically segregated.

FIG. 2 also shows the magnetic core 18 of the transformer 11 and the magnetic core 28 of the transformer 21. The term "magnetic core" is used to mean a portion of the magnetic circuit in which the same-direction flux created by a coil is the greatest.

Figure 3A:
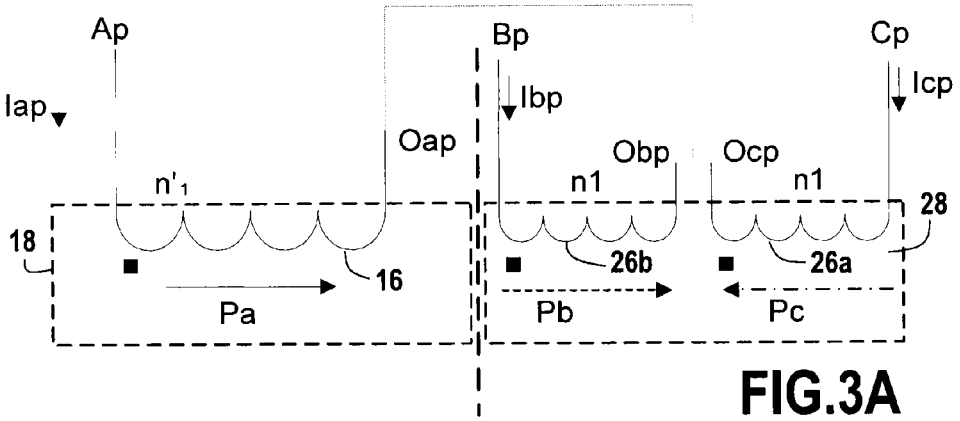
FIGS. 3A and 3B are electric circuit diagrams showing a plurality of variant connections for the coils of the FIG. 2 transformer.

FIG. 3A is an electric circuit diagram showing the way the coils 16 and 26 are connected.

In FIG. 3, there can be seen:

- Ap, Bp, and Cp, which are the terminals of the coils 16, 26*b*, and 26*a*, respectively, that are connected to the three-phase network;
- Oap, Obp, Ocp, which are the terminals of the coils 16, 26*b*, and 26*a*, respectively, that are opposite from the terminals Ap, Bp, and Cp;
- Iap, Ibp, and Icp, which are the three-phase currents entering the terminals Ap, Bp, and Cp, respectively;
- Pa, which is the magnetic potential in the magnetic core 18 corresponding to the current Iap;
- Pb which is the magnetic potential in the magnetic core 28 corresponding to the current Ibp; and
- Pc which is the magnetic potential in the magnetic core 28 corresponding to the current Icp.

As shown in FIG. 3A, the terminal Oap of the coil 16 is connected to the terminals Obp and Ocp of the coils 26*b* and 26*c*, which thus constitutes the midpoint of the coil 26.

Furthermore, FIG. 3A shows the winding directions of the coils 16, 26*a*, and 26*b* by means of black dots, using the following convention:

- if the black dot is on the left and the current enters on the same side as the black dot, then the corresponding magnetic potential goes to the right;
- if the black dot is on the left and the current enters from the side opposite from the black dot, then the corresponding magnetic potential goes to the left;
- if the black dot is on the right and the current enters on the same side as the black dot, then the corresponding magnetic potential goes to the right; and
- if the black dot is on the right and the current enters from the side opposite from the black dot, then the corresponding magnetic potential goes to the left.

Figure 3B:
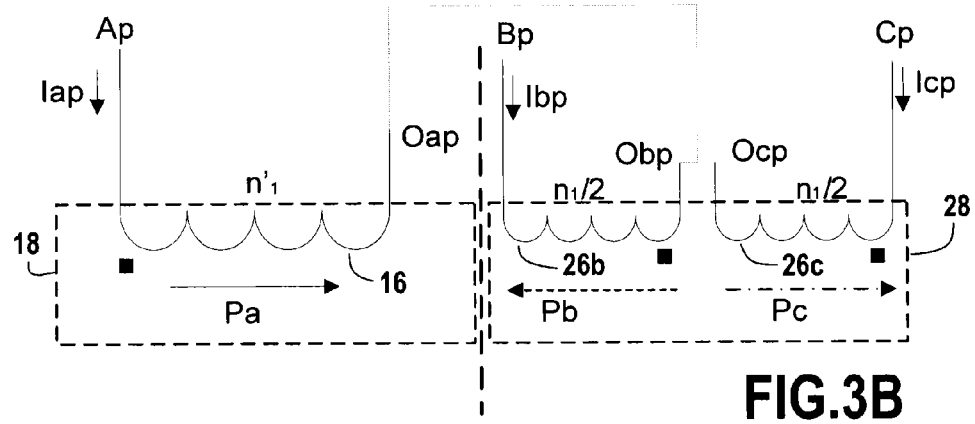

Given the winding directions of the coils 26*a* and 26*b*, it can thus be seen that the magnetic potentials Pb and Pc in the magnetic core 28 are in opposite directions. FIG. 3B shows a variant for the winding directions, that likewise makes it possible to obtain magnetic potentials Pb and Pc in opposite directions.

Below, $V_1$, $I_1$, $V_2$, and $I_2$ designate the two-phase voltages and currents in the coils 17 and 27.

Figure 1:
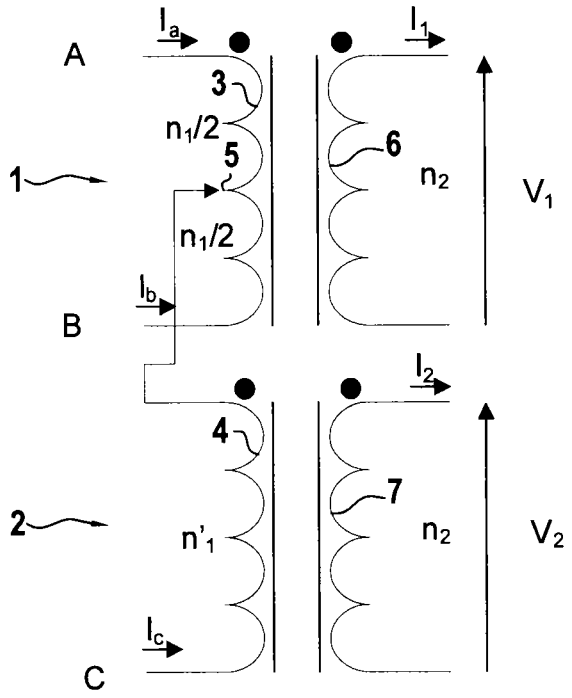
FIG. 1 is an electric circuit diagram of a prior Scott connection three-phase/two-phase stationary transformer.

It can be seen that the transformer 10 is a Scott connection three-phase/two-phase rotary transformer. In similar manner to the Scott connection three-phase/two-phase stationary transformer 1 of FIG. 1, the primary voltages are in quadrature, and the same applies to the secondary voltages $V_1$ and $V_2$.

For a ratio $n'_1=(\sqrt{3}/2)n_1$, the secondary voltages $V_1$ and $V_2$ have the same value and are in quadrature. The ratio of the currents is given by:

$$\frac{I_c}{I_2} = \frac{2}{\sqrt{3}}\frac{n_2}{n_1}$$

Resistances are balanced by appropriately selecting the sections for the conductive materials of the coils 16, 26*a*, and 26*b*: the sections of the coils 26*a* and 26*b* are equal if their mean distances from the axis of rotation are equal. The section of the coil 16 is √3 times the section of the coils 26*a* and 26*b* for the same mean distance from the axis of rotation. If it is desired to conserve balanced resistances in the phases, the longest phase must also have a larger section in order to compensate for its greater length. The magnetic coupling performed by the magnetic circuit of the single-phase rotary transformer 21 possesses two phases, thereby making it possible to obtain a coupling coefficient of √3 for the fluxes created compared with a single-phase transformer per phase. This coefficient makes it possible either to reduce the number of coil turns per phase, or else to reduce the magnetizing current that is absorbed.

The transformer 10 presents several advantages. It makes it possible to transfer energy or signals between a three-phase source and a two-phase source in reference frames that are rotating relative to each other, and to do so without contact and in balanced manner. Furthermore, the volume and the weight of the transformer 10, corresponding to the volumes and to the weights of the two single-phase rotary transformers 11 and 21, can be reduced compared with the three-transformer solution mentioned in the introduction, in which the three-phase/two-phase transformation is performed by a first transformer that is stationary, and then the change of reference phase is performed by two single-phase rotary transformers. Finally, it requires only toroidal coils of axis A, which are particularly simple in structure.

In FIG. 2, the coils 26*a* and 26*b* are shown as being one beside the other, however other positions may be suitable. For example, in the slot 24, the coils 26*a* and 26*b* may be one beside the other in the axial direction, one around the other relative to the axis A, or they may be mixed together.

The transformer 10 may be considered as a U-shaped variant in which the three-phase portion surrounds the two-phase portion relative to the axis A. In a variant, the two-phase portion may surround the three-phase portion relative to the axis A.

Figure 4:
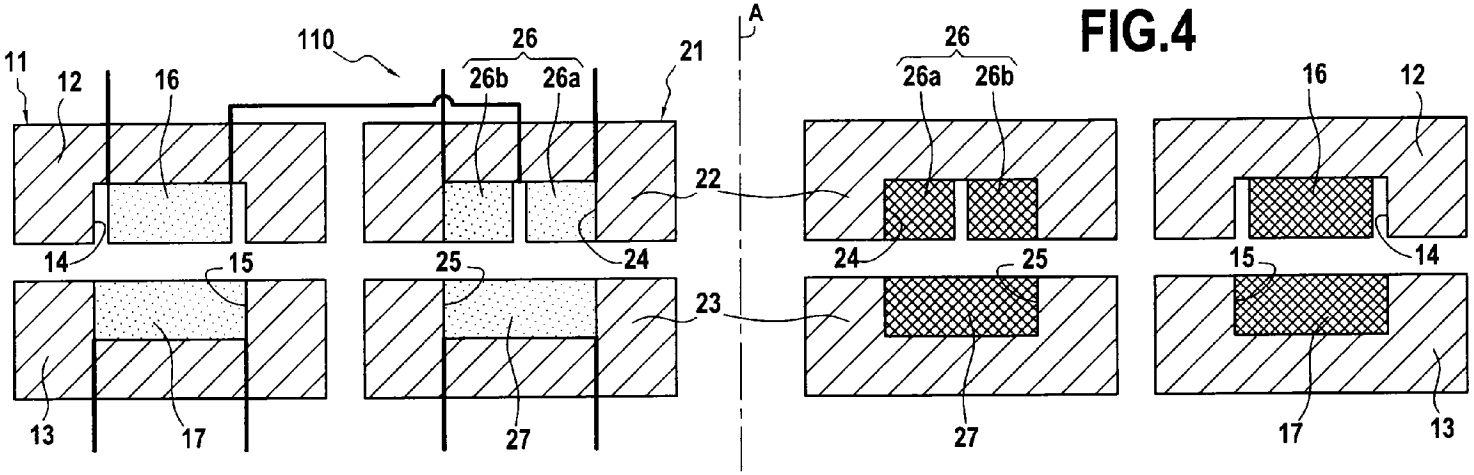
FIG. 4 is a section view of a three-phase/two-phase rotary transformer in a second embodiment of the invention.

FIG. 4 is a section view of a transformer 110 in a second embodiment of the invention. The transformer 110 is a three-phase/two-phase rotary transformer and it may be considered as being an "E-shaped" or a "pot-shaped" variant of the "U-shaped" transformer 10. In this variant, the three-phase portion and the two-phase portion are situated one beside the other in the direction of the axis A, and the slots 14 and 15 are open towards each other in the direction of the axis A. In FIG. 4, the same references as in FIG. 2 are used again without risk of confusion for designating elements that correspond, and a detailed description is therefore not necessary.

In known manner in the field of transformers, a transformer may have a plurality of secondaries. Thus, a transformer in accordance with the invention may comprise for its primary, a three-phase portion of the same type as the three-phase portion 31 of the transformer 10 or 110, and for its secondary, a two-phase secondary portion of the same type as the two-phase portion 32 of the transformer 10 together with at least one set of additional three-phase or two-phase coils.

This makes it possible to power an arbitrary number of loads in balanced manner from a three-phase source. For example, in order to power 11 loads, it is possible to use three loads on the three-phase secondary and two loads on the two-phase secondary (11=3*3+2).

Figure 5:
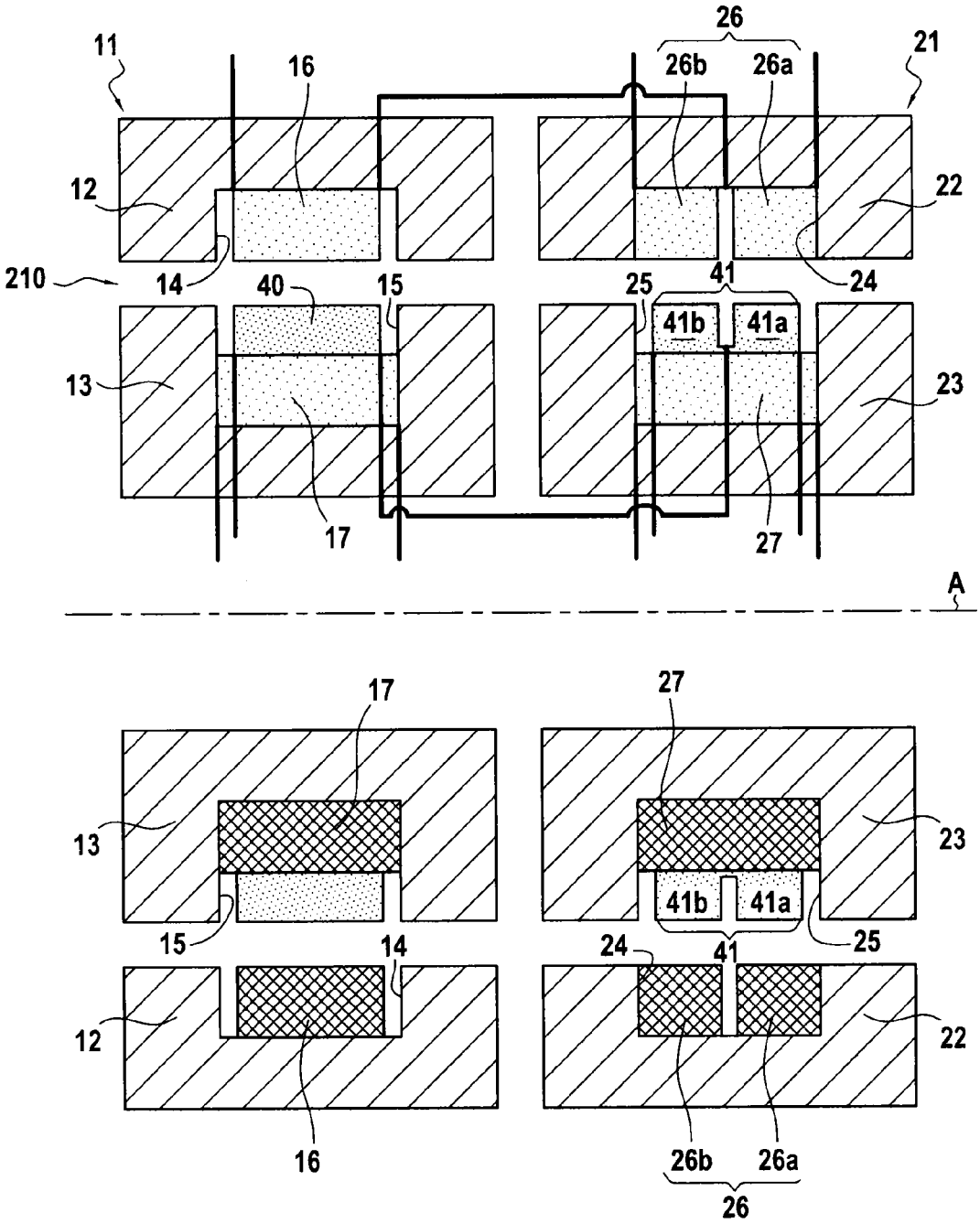
FIG. 5 is a section view showing a variant of the FIG. 2 transformer having a plurality of secondaries.

FIG. 5 shows an example of a transformer 210 having a plurality of secondaries. The transformer 210 may be considered as a variant of the transformer 10 and it further comprises a set of three-phase coils for its secondary. Elements corresponding to embodiments of the transformer 10 are designated by the same references, without risk of confusion. The transformer 210 also has an n√3-turn toroidal coil 40 of axis A in the slot 15 and an $n_3$-turn toroidal coil 41 of axis A in the slot 25. The coil 41 is made up of two half-coils 41*a* and 41*b*, each having $n_3/2$ coils. The coils 40, 41*a*, and 41*b* are connected to one another and to the secondary three-phase source in a manner that corresponds to the connection of the coils 16, 26*a*, and 26*b*.

Figure 6:
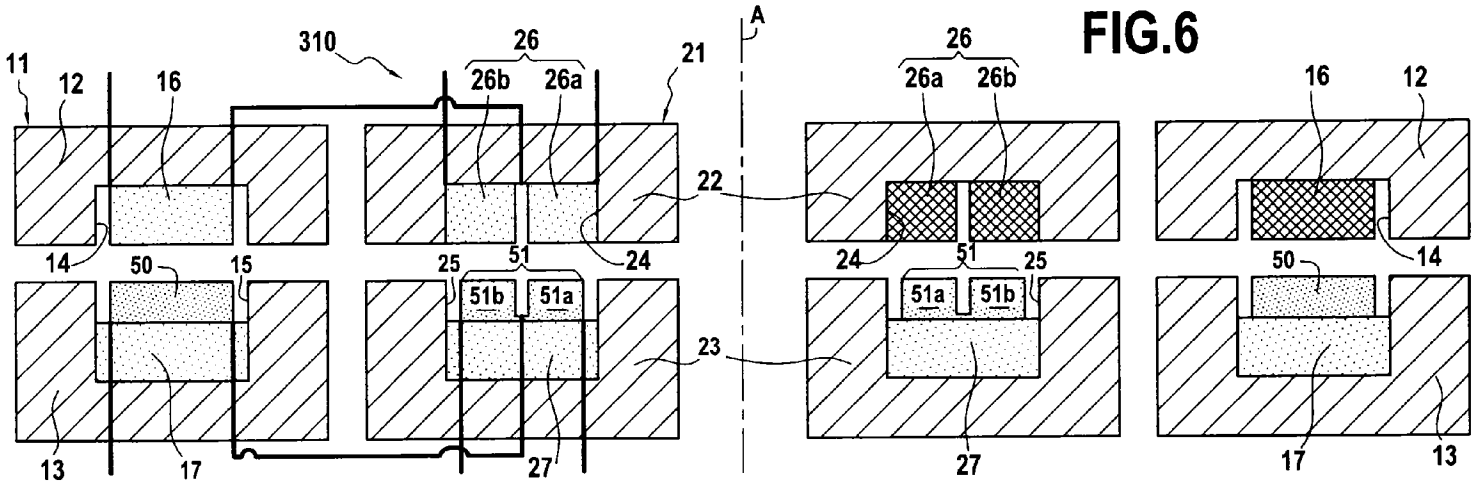
FIG. 6 is a section view of a variant of the FIG. 4 transformer, having a plurality of secondaries.

In corresponding manner, FIG. 6 shows another example of a transformer 310 having a plurality of secondaries. The transformer 310 may be considered as being a variant of the transformer 110, and it further comprises a set of three-phase coils for its secondary. Elements that correspond to elements of the transformer 110 are designated by the same references, without risk of confusion. The transformer 310 also has an n√3-turn toroidal coil 50 of axis A in the slot 15, and an $n_3$-turn toroidal coil 51 of axis A in the slot 25. The coil 51 is made up of two half-coils 51*a* and 51*b*, each having $n_3/2$ turns. The coils 50, 51*a*, and 51*b* are connected to one another and to the secondary three-phase source in a manner that corresponds to the connection of the coils 16, 26*a*, and 26*b*.

The invention claimed is:

1. A three-phase/two-phase rotary transformer, comprising a first single-phase rotary transformer and a second single-phase rotary transformer, said first transformer comprising a first body made of ferromagnetic material defining a first annular slot of axis A, an $n'_1$-turn first toroidal coil of axis A in the first slot, a second body made of ferromagnetic material defining a second annular slot of axis A that is open towards said first slot, and an $n_2$-turn second toroidal coil of axis A in the second slot;

said second transformer comprising a third body made of ferromagnetic material defining a third annular slot of axis A, an $n_1$-turn third toroidal coil of axis A in the third slot, a fourth body made of ferromagnetic material defining a fourth annular slot of axis A that is open towards said third slot, and an $n_2$-turn fourth toroidal coil of axis A in the fourth slot, wherein one terminal (Oap) of the first coil is connected to the midpoint (Obp, Ocp) of the third coil, said first body, said first coil, said third body, and said third coil being stationary relative to one another and forming a three-phase portion of the transformer, said second body, said second coil, said fourth body, and said fourth coil being stationary relative to one another and forming a two-phase portion of the transformer, and said three-phase portion and said two-phase portion being movable in rotation about the axis A relative to each other.

2. A transformer according to claim 1, wherein $n'_1=(\sqrt{3}/2)\,n_1$.

3. A transformer according to claim 1, wherein the ratio between the section of the electrically conductive material of the first coil and the section of the electrically conductive material of the third coil is equal to √3.

4. A transformer according to claim 1, wherein said third coil comprises a first half-coil and a second half-coil that are joined together by said midpoint (Obp, Ocp), the winding directions of said half-coils corresponding to magnetic potentials of opposite directions (Pb, Pc) for currents (Ipb, Icp) entering via the terminals (Bp, Cp) of the third coil (26).

5. A transformer according to claim 1, further including at least one set of additional three-phase or two-phase coils.

6. A transformer according to claim 1, wherein the three-phase portion surrounds the two-phase portion relative to the axis A, or vice versa.

7. A transformer according to claim 1, wherein the three-phase portion and the two-phase portion are situated one beside the other in the direction of the axis A.

* * * * *